US006564882B2

(12) United States Patent
Durmeyer et al.

(10) Patent No.: US 6,564,882 B2
(45) Date of Patent: May 20, 2003

(54) ELECTROMAGNETIC HAMMER HAVING A MOVING FERROMAGNETIC MASS

(75) Inventors: Gérard Durmeyer, Mittersheim (FR); Marc Delplanco, Bastogne (BE)

(73) Assignee: Entreprise de Travaux Publics et Prives Georges Durmeyer, Mittersheim (FR)

( * ) Notice: Subject to any disclaimer, the term of this patent is extended or adjusted under 35 U.S.C. 154(b) by 85 days.

(21) Appl. No.: 09/737,094

(22) Filed: Dec. 14, 2000

(65) Prior Publication Data

US 2001/0004939 A1 Jun. 28, 2001

(30) Foreign Application Priority Data

Dec. 22, 1999 (FR) ..... 99 16226

(51) Int. Cl.[7] ..... B23B 45/16
(52) U.S. Cl. ..... 173/117; 173/131; 173/91
(58) Field of Search ..... 173/117, 131, 173/91, 114; 318/130, 135

(56) References Cited

U.S. PATENT DOCUMENTS

| | | | | |
|---|---|---|---|---|
| 1,753,454 A | * | 4/1930 | Weyandt | 310/30 |
| 3,681,629 A | * | 8/1972 | Drye | 310/14 |
| 3,811,313 A | * | 5/1974 | Schut | 173/117 |
| 3,956,575 A | * | 5/1976 | Sutherland | 174/72 R |
| 4,120,672 A | * | 10/1978 | Lanese | 173/117 |
| 4,215,297 A | | 7/1980 | Jacquemet | |
| 4,390,307 A | * | 6/1983 | Rice | 173/117 |
| 4,468,594 A | | 8/1984 | Jacquemet | |
| 4,799,557 A | | 1/1989 | Jacquemet | |
| 5,168,118 A | * | 12/1992 | Schroeder | 124/3 |
| 5,168,939 A | | 12/1992 | Schroeder | |
| 5,404,633 A | * | 4/1995 | Givler | 29/434 |
| 6,005,464 A | * | 12/1999 | Sakamaki et al. | 123/634 |

FOREIGN PATENT DOCUMENTS

| | | | |
|---|---|---|---|
| FR | 2 765 904 | 1/1999 | |
| FR | WO 9902787 | * 1/1999 | E02D/7/06 |
| JP | 56 153 018 | 11/1981 | |

* cited by examiner

*Primary Examiner*—Rinaldi I. Rada
*Assistant Examiner*—Louis Tran
(74) *Attorney, Agent, or Firm*—McCormick, Paulding & Huber LLP

(57) ABSTRACT

The invention relates to an electromagnetic hammer having a moving ferromagnetic mass, the hammer being of the type comprising a tube of non-magnetic material for standing on an element that is to be driven into the ground, said tube being surrounded by a peripheral coil connected to electrical power supply and slidably receiving the moving mass. According to the invention, the peripheral coil is subdivided into a plurality of independent coils, each independent coil being received in an associated casing and being wound around a cylindrical inner wall of said casing, the cylindrical inner walls of the casings being superposed to make up the tube in which the moving mass slides, each casing also taking up axial forces, and a junction box enabling the corresponding coil to be connected to associated electrical power supply cables.

10 Claims, 3 Drawing Sheets

ELECTROMAGNETIC HAMMER HAVING A MOVING FERROMAGNETIC MASS

The present invention relates to an electromagnetic hammer having a moving ferromagnetic mass.

BACKGROUND OF THE INVENTION

Such hammers are used, for example, on building sites for driving piles in the form of stakes or sheets by percussion, and for doing so in a wide variety of ground types.

A known electromagnetic hammer comprising a tube carrying a coil and having both a moving ferromagnetic mass and an anvil in the vicinity of one of its ends is described in document JP-A-56 153 018, for example. That type of hammer presents numerous drawbacks, and the main drawback is the lack of any rigid support for the coil, such that while the mass is being raised, said coil is subjected to a considerable reaction force causing it to become compacted. In use, these successive deformations of the coil cause the performance of the electromagnetic hammer to diminish and can lead to the coil being damaged.

Document U.S. Pat. No. 5,168,939 discloses a device for drilling an oil well with an electromagnetically accelerated impactor, the device comprising a plurality of coil modules separated from one another merely by spacers and stacked one on another in a carrier structure Building up the coil as a plurality of independent modules makes it possible to control the electromagnetic force generated by each module. The stack of coil modules is prestressed so as to prevent the modules separating from one another in use, particularly under the effect of the electromagnetic reaction as the impactor goes past. The impactor is inserted manually into the top of the device so that no provision is made for it to be raised by means of an electromagnetic force generated by the coil modules. The problem of the modules withstanding the compression induced by the electromagnetic reaction while the impactor is being raised is not addressed in that document even though that problem constitutes a major weakness for such a device whose modules can deteriorate rapidly. That document does not address questions of sealing, either.

For technological background, reference can also be made to the following documents: U.S. Pat. No. 4,799,557, U.S. Pat. No. 4,468,594, and U.S. Pat. No. 4,215,297.

More recently, proposals have been made for a higher-performance electromagnetic hammer in which the coil is made by being wound around the hammer tube, said tube being made of a non-magnetic material and having means for taking up axial forces and for transmitting said forces to the anvil while the mass is being raised.

One such electromagnetic hammer is described in document FR-A-2 765 904 assigned to the Applicant. In a particular embodiment, provision is made for an additional coil made by winding around the same central tube at an axial position situated between the coil and the anvil, said additional coil being connected to the main coil so as to be powered by the current induced therein as the mass travels downwards.

Nevertheless, winding the coil directly on the tube for the electromagnetic hammer as described above presents certain drawbacks that are explained below.

Using a one-piece internal tube whose length is about 4 meters (m) to 5 m means that it cannot be impregnated with an electrical varnish since the length of such a tube greatly exceeds the capacity of the impregnation baths that are conventionally used. Consequently, the internal tube of the electromagnetic hammer is relatively vulnerable to moisture, and to mechanical jamming due to the tube swelling. Furthermore, it has been found that the bottom portion of the coil wound directly on the tube is very highly stressed in use. As an indication, the compression force on the coil while the mass is being raised corresponds to a force of about 20 (metric) tonnes. As a general rule, the coils used are made by winding a conductor whose section is in the form of a rectangular flat extending in the height direction. Consequently, very high pressure exerted vertical on the windings of the coil run the risk of giving rise to plastic deformation of the coil material (generally copper). The effect of this deformation is to crush the insulation concerned, which leads progressively to turns becoming short-circuited one to another. The phenomenon amplifies quickly since the reduction in electrical resistance gives rise to an increase in temperature rise and consequently to the insulation being destroyed by short-circuiting or by overheating. Finally, it has been found that the above-described electromagnetic hammer structure is relatively vulnerable to moisture due to it being very difficult to make the coil waterproof. Under such circumstances, if the coil becomes damaged, it is necessary to stop using the electromagnetic hammer and then to remove the coil from the central tube, and that can only be done with equipment that is heavy and bulky, giving rise to the drawback of a prolonged interruption in work.

OBJECTS AND SUMMARY OF THE INVENTION

The present invention seeks to resolve the above-mentioned problem by designing an electromagnetic hammer that does not suffer from the above drawbacks or limitations, while nevertheless conserving the advantages of the structure described in above-mentioned document FR-A-2 765 904.

This problem is solved by the invention by means of an electromagnetic hammer having a moving ferromagnetic mass, the hammer being of the type comprising a tube of non-magnetic material for standing on an element that is to be driven into the ground, said tube being surrounded by a peripheral coil connected to electrical power supply means and slidably receiving the moving mass, the hammer being remarkable in that the peripheral coil is subdivided into a plurality of independent coils, each independent coil being received in an associated casing and being wound around a cylindrical inner wall of said casing, the cylindrical inner walls of the casings being superposed to make up the tube in which the moving mass slides, each casing also having means for taking up axial forces, and a junction box enabling the corresponding coil to be connected to associated electrical power supply cables.

Making the coil as a plurality of independent coils received in associated casings makes it possible to distribute the forces exerted on the bottom of each coil, so that the total force to be withstood is divided by the number of independent coils used. This ensures that the stress applied to the windings of each coil is limited to a considerable extent while avoiding the risk of the insulation being crushed and the coil being short-circuited.

Preferably, each coil is received in watertight manner in its associated casing, the reception housing being defined by end rings and by a cylindrical outer wall. In particular, each coil is held inside its reception housing by a filler resin. Thus, each winding is well protected against external attack, and the electromagnetic hammer can be operated in surroundings that are very wet.

It is then advantageous for each casing to be defined by a bottom ring and a top ring, one of which is an end ring defining the reception housing for the coil, and the other of which is disposed at a distance from the other end ring, with reinforcing spacers being interposed, said rings and spacers constituting said means for taking up axial forces. Securing the coil inside the associated casing serves both to take up and to limit the axial compression forces on the windings concerned.

Also advantageously, the junction box of each casing is external and waterproof.

It is then preferable for each junction box to be disposed between two rings of the casing, and to comprise a waterproof housing associated with the inlet and outlet connections of the coil and from which there projects a terminal box receiving elements for connection to the corresponding cables. In particular, the waterproof housing associated with the junction box is filled with a coating material, in particular liquid silicone. The use of such external boxes enables each coil to be tested separately and enables any faults to be identified.

Also preferably, the superposed casings are interconnected by releasable connections, in particular by bolt fastenings, so that each casing is individually interchangeable. In particular, the coils are arranged to enable said hammer to operate in an impaired mode in the event of one of the coils being damaged. Thus, when a fault is detected, the defective coil can be taken electrically out of service by an external modification to the cabling, without that interrupting operation of the hammer which then continues to operate with impaired performance, i.e. with voltages and hammering rates that are reduced. In addition, in the event of a fault in a casing, the external mechanical and electrical accessibility makes it possible for site personnel to swap casings quickly, thereby avoiding the need to take the production tool out of operation for too long.

Because of its modular structure, it is then possible to repair the damaged casing on its own, thereby reducing the cost and the time required for reconditioning.

In a particular embodiment, the n coils are electrically connected in series or in parallel, with the 2n corresponding cables being connected to a connection bar junction box. These connection systems make it possible to bypass a damaged coil very quickly.

In a variant, provision can be made for the n coils to be electrically connected in series, with the two corresponding cables being connected to an external junction box.

BRIEF DESCRIPTION OF THE DRAWINGS

Other characteristics and advantages of the invention appear more clearly in the light of the following description and the accompanying drawings, relating to a particular embodiment and given with reference to the figures, in which.

MORE DETAILED DESCRIPTION

Figure 1:
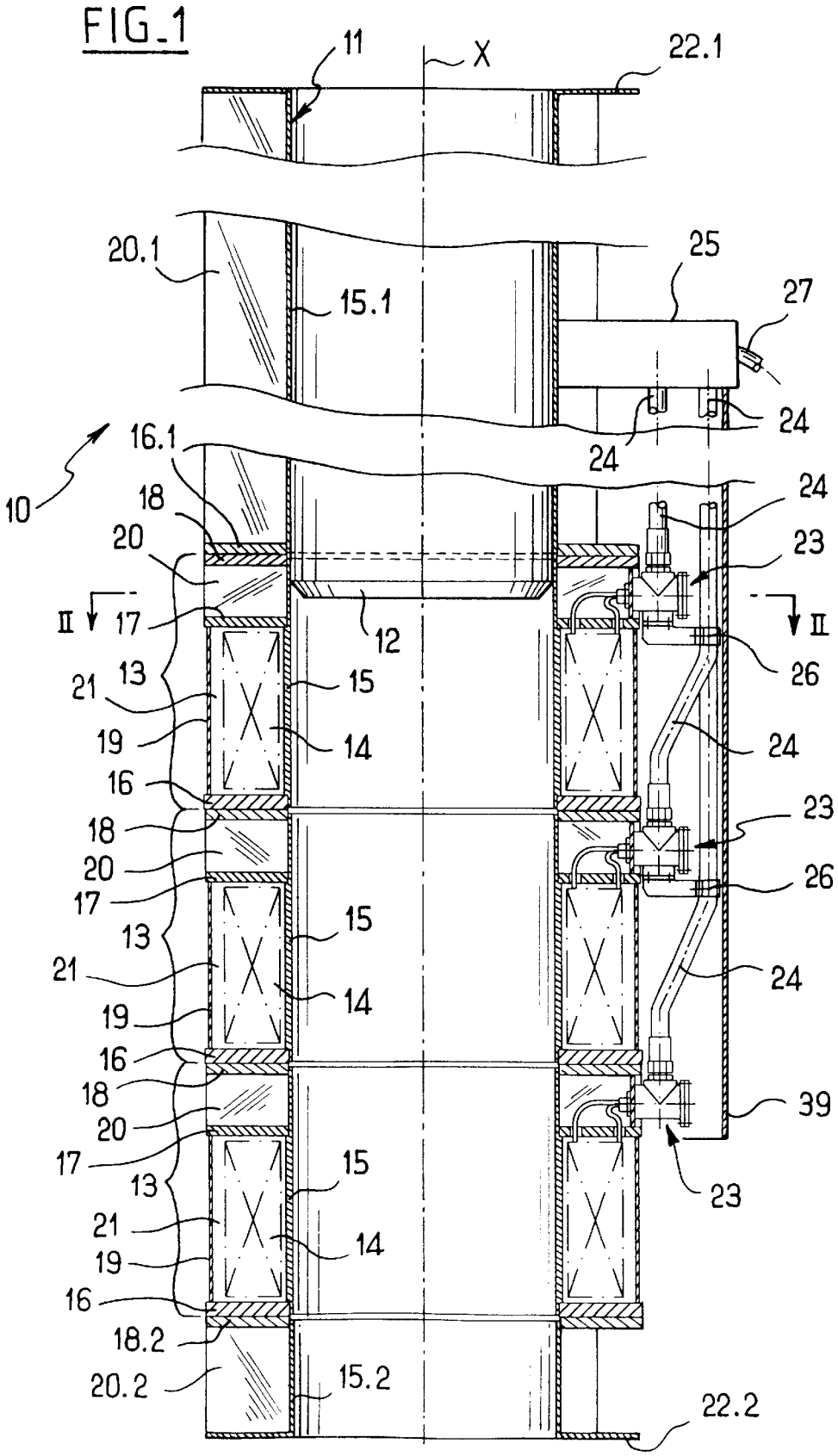
FIG. 1 is an axial section of an electromagnetic hammer of the invention, in this case comprising three independent coils constituting the peripheral coil, said independent coils being connected electrically in parallel.

FIG. 1 shows an electromagnetic hammer 10 of the invention, the hammer being of the type comprising a tube 11 of non-magnetic material for standing on an element engaged in the ground (not shown), said tube being surrounded by a peripheral coil connected to electrical power supply means (not shown here), and slidably receiving a moving ferromagnetic mass referenced 12. The axis of the electromagnetic hammer 10 coincides with the central axis of the tube 11 and is referenced X.

According to an essential characteristic of the invention, the peripheral coil is subdivided into a plurality (in this case three) independent coils referenced 14, each coil 14 being received in an associated casing 13 and being wound around a cylindrical inside wall 15 of said casing, and the cylindrical walls 15 of the casings 13 are superposed so as to make up the tube in which the moving mass 11 slides.

Thus, contrary to the single one-piece tube described for the electromagnetic hammer in above-mentioned document FR-A-2 765 904, the central tube of the present electromagnetic hammer 10 is made up of superposed segments, each segment being constituted by the inside wall of a casing that receives an independent coil. Thus, each coil 14 is received in watertight manner in its associated casing 13, with the associated reception housing 21 being defined by end rings 16, 17 and by a cylindrical outer wall 19. This modular design will be better understood on referring to FIG. 3 which shows the various walls that define the reception housing 21 associated with a coil 14.

Figure 3:
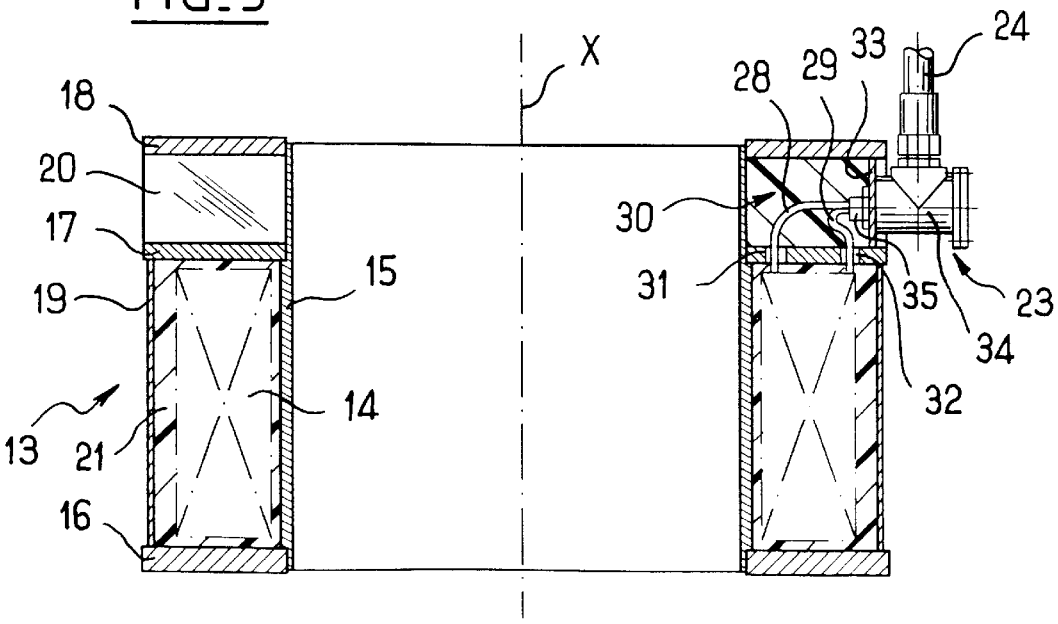
FIG. 3 is an axial section, on a larger scale, showing a casing together with its coil and its associated junction box.

In practice, such a coil casing is made initially by winding the coil around the cylindrical inner wall 15 until the coil 14 has been built up. It is then advantageous to provide for each coil 14 to be held in its reception housing 21 by means of a filler resin. Thereafter, the casing is closed by welding on two end rings 16, 17 and a cylindrical outer peripheral wall 19. In FIG. 3, it can be seen that the reception housing 21 is filled by this filler. It can also be seen that the cylindrical inner wall 15 has a bearing shoulder for each of the end rings 16, 17. This ensures that axial forces are transmitted from the rings to the central wall 15 so that axial forces are taken up.

Each casing 13 is also defined by a bottom ring 16 and a top ring 18, one of which (the ring 16) is one of the end rings defining the housing 21 for receiving the coil 14, while the other one (the ring 18) is disposed at a distance from the other end ring 17, with reinforcing spacers referenced 20 being interposed between them. The radial arrangement of the reinforcing spacers 20 can be seen more clearly in the section of FIG. 2. For each casing 13, the rings 16, 17, and 18 together with the spacers 20 constitute means for taking up axial forces, and these means do not bear directly against the top or bottom ends of the independent coils 14.

With reference to FIG. 1, it can be seen that the electromagnetic hammer 10 comprises, above the top casing, a tubular core 15.1 extending the cylindrical inside wall 15 of said casing, and that radial reinforcing spacers 20.1 are provided to take up axial forces, which spacers can be vertically aligned with the spacers provided in the various casings. Similarly, beneath the bottom casing there is a tubular core 15.2 extending the cylindrical inner wall 15 of said casing downwards, and it has radial reinforcing spacers referenced 20.2. The tubular cores 15.1 and 15.2, together with the cylindrical inner wall 15 of the various casings 13, thus make up the central tube of non-magnetic material of the electromagnetic hammer 10. At the top, there can also be seen an end flange 22.1 and at the bottom there can be seen a bearing flange 22.2. The top and bottom portions of the electromagnetic hammer are connected together via the rings defining respectively the top of the top casing and the bottom of the bottom casing. Thus, at the top, there is provided a ring 16.1 secured to the top ring 18 of the top casing 13, and at the bottom, a ring 18.2 secured to the bottom ring 16 of the bottom casing.

Although not shown here, the superposed casings 13 are connected to one another by releasable links via their contacting rings, in particular by bolt fastenings, so that each casing 13 can be interchanged individually.

In FIG. 1, it can be seen that each casing 13 also has a junction box referenced 23 enabling the corresponding coil 14 to be connected to associated electrical power supply cables. Specifically, provision is made for the three coils 14 to be electrically connected in parallel, with the six corresponding cables 24 being connected to a junction box containing a connection bar and referenced 25. A cable guide 26 is provided through the central casing and the top casing so as to allow the cables 24 to rise vertically to the junction box 25. The connection bar system (not shown) serves to change over quickly from a series connection configuration to a parallel connection configuration. It is thus easy, if necessary, to organize a bypass for a faulty coil by acting on the corresponding pair of connection bars. Under such circumstances, assuming that one of the coils 14 has been damaged, the electromagnetic hammer can still operate, although with impaired performance. The junction box 25 with connection bars also receives three cables 27 (only one is visible in FIG. 1) corresponding to positive, negative, and ground terminals. This thus enables the electromagnetic hammer to be connected to electrical power supply means, e.g. of the type described in above-mentioned document FR-A-2 765 904.

Figure 2:
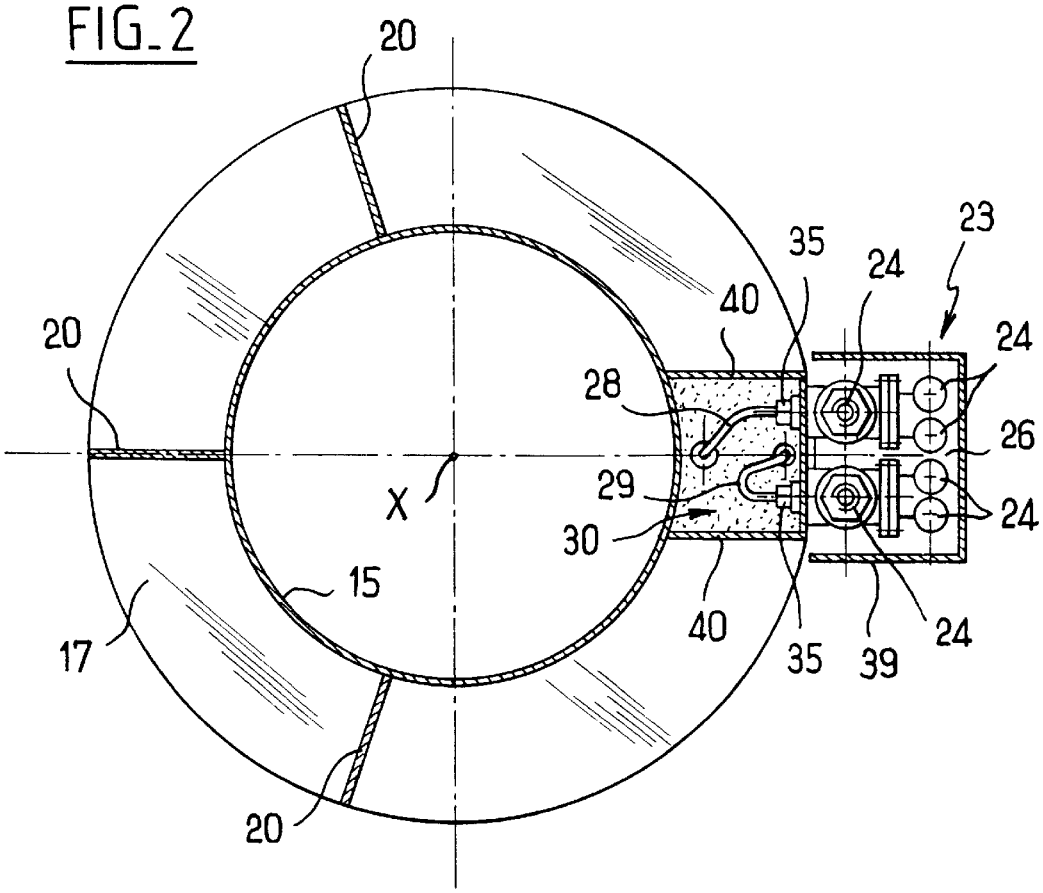
FIG. 2 is a section on II—II of FIG. 1 on a larger scale, showing the junction box zone more clearly.

As can be seen more clearly in the section of FIG. 2, an external covering 39 is also provided to hide the sets of cables 24 and the associated junction boxes 23.

In a variant, provision could naturally be made for the independent coils 14 to be electrically connected in series with the two cables concerned being connected to an external junction box (variant not shown). That kind of connection presents the advantage of having only two cables at the general external junction box, and thus only two terminals in addition to ground, thereby avoiding risks of wrong connections. Nevertheless, the use of a junction box having connection bars as described above would appear to be more flexible, particularly when dealing with a faulty coil or casing.

Returning to the section of FIG. 3, it is described above how the independent coil 14 is held in its reception housing 21 by a filler resin, thus ensuring that the coil is completely waterproof inside the casing so as to guarantee that it can operate in very wet surroundings. The same desire for waterproofing also relates to the connections made to each of the independent coils 14 by the associated cables 24.

The inlet strand referenced 28 of the coil 14 passes through the ring 17 via a hole 31, and its outlet strand 29 passes through a passage 32 in the same ring 17 to be joined to associated junction elements 35. Each junction box 23 is located between two rings 17 and 18 of the casing 13, and has a sealed housing 30 associated with the junctions between the inlet and outlet strands 28 and 29 of the coil 14 from which there projects a terminal box 34 receiving said connection elements 35. As can be seen in FIGS. 2 and 3, the waterproof housing 30 associated with the junction box 23 is filled with a potting material, in particular liquid silicone. This coating material is particularly advantageous since it serves simultaneously to provide waterproofing at the junctions, and also to provide mechanical locking and protection against any external penetration of moisture. The connection elements 35 pass through a wall 33 closing the waterproof housing 30 on its radially outer side. On its radially inner side, the housing 30 is defined by the central cylindrical wall 15 of the casing 13. On its sides, two end plates 40 are provided which also act as stiffeners for taking up and transmitting axial forces. Thus, operatives needing to handle the connection members from the outside have access only to the terminals 34 and there is no risk of action being taken on the sealed portion of the connection.

Figure 4:
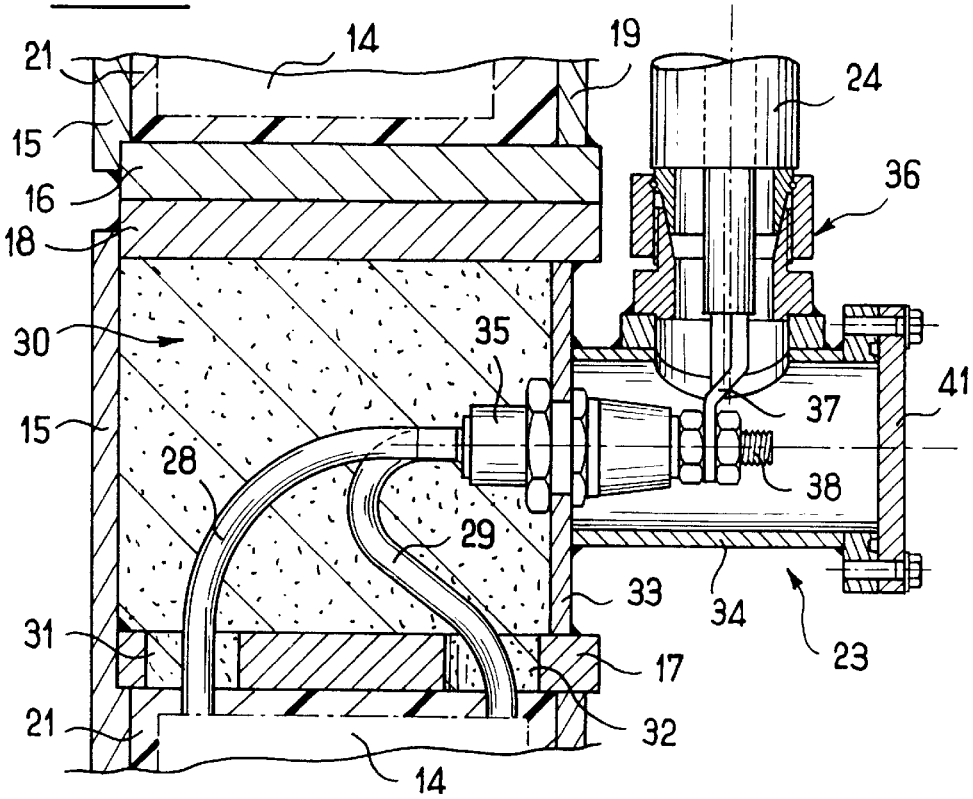
FIGS. 4 and 5 are details on a larger scale in section respectively on a plane containing the axis of the hammer and on a plane perpendicular to said axis, through the junction box zone of a coil.
Figure 5:
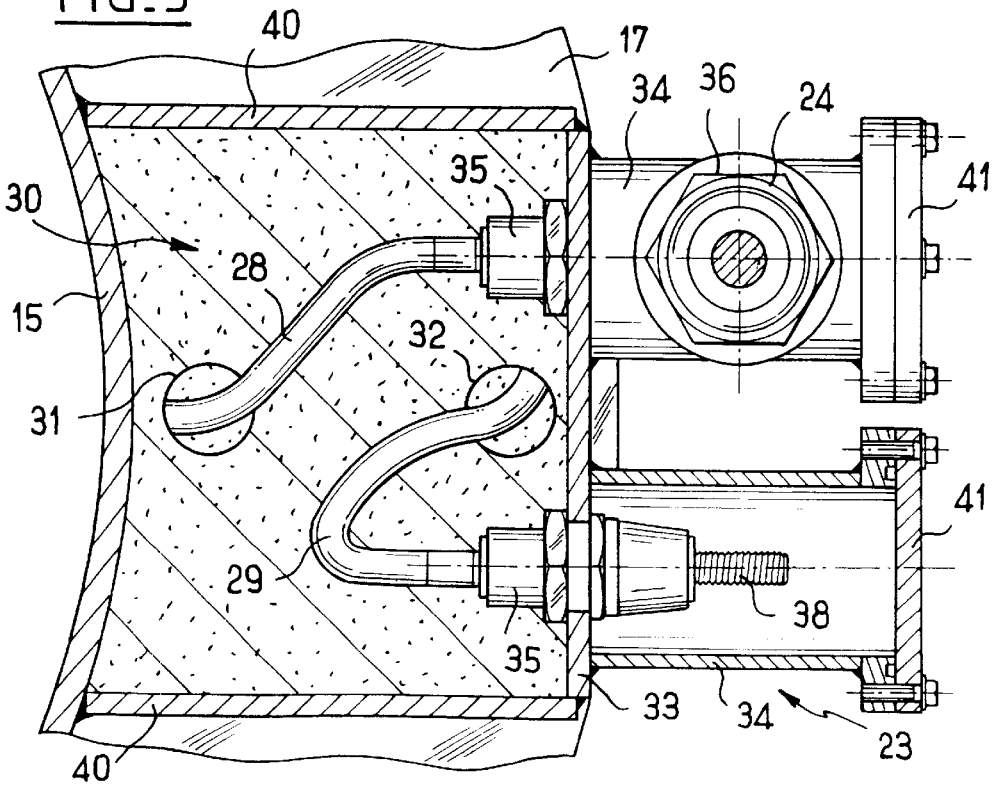

FIGS. 4 and 5 show more clearly the arrangement of these components in a junction box 23. The waterproof coating of the inlet and outlet strands 28 and 29 of the coil 14 can clearly be seen in the waterproof housing 30. It can also be seen that connection to the cable 24 takes place via a ring terminal 37 passed over the threaded end 38 of each connection element 35 and secured thereto by a nut, with the nut being tightened from the outside after a cover 41 closing the terminal box 34 has been removed. The cable 24 is secured to the terminal box 34 by a mechanical junction 36 analogous to the junction already in use for hydraulic hoses. Thus, the junctions in the terminal box 34 are well protected from the outside.

It will be understood that the total compression to which the independent coils are subjected is divided by the number of casings, thereby making it possible to limit the amount of crushing to which each individual coil is subjected. Furthermore, the way each coil is held inside its casing ensures that axial crushing forces applied to the windings concerned are taken up and limited. The rings and the stiffeners of each casing take up the axial forces and direct them towards the central tube and the peripheral walls of the casings.

The external configuration of the junction boxes 23 allow each individual coil to be tested separately, thereby making it possible to locate any faults.

Under such circumstances, and as already mentioned above, the faulty coil can be taken electrically out of service by an external modification to the wiring, and that will not prevent the hammer from continuing to operate in impaired mode.

If a major fault occurs in a casing, then the external mechanical and electrical accessibility of the casings means that on-site personnel can quickly swap the damaged casing with a spare, thereby ensuring that the downtime of the production tool is not too long. It is also possible to repair a single damaged casing on its own, which means that the cost and the time required for reconditioning is reduced. The complete coating of the coil also provides total security for operating and maintenance personnel.

If a coil is damaged, the casing concerned can easily be extracted by undoing the mechanical connections concerned, and by lifting the portion of the hammer that lies above the casing in question. Such an operation would naturally be impossible with a one-piece central tube as described in above-mentioned document FR-A-2 765 904.

With a damaged coil, if the coil is crushed, it is taken out of its coating by using a vertical lathe, and then the casing is put into a pyrolytic oven to burn off the insulation, thus enabling the copper of the windings and the metal components of the casing to be recovered. If the insulation ages, it is removed in like manner, and then the coil is reimpregnated in a tank with the wire remaining wound, after which the casing is closed again using a polymerized resin.

An electromagnetic hammer is thus provided which is capable of operating in very wet conditions, and whose structure makes it possible to avoid the coil becoming excessively compacted, even under very severe operating conditions. In addition, the interchangeability of the casings provides a high degree of flexibility and reliability that are most advantageous.

The invention is not limited to the embodiments described above, but on the contrary covers any variant using equivalent means to reproduce the essential characteristics specified above.

What is claimed is:

1. An electromagnetic hammer having a moving ferromagnetic mass, the hammer being of the type comprising a tube of non-magnetic material for standing on an element that is to be driven into the ground, said tube being surrounded by a peripheral coil connected to electrical power supply means and slidably receiving the moving mass, wherein the peripheral coil is subdivided into a plurality of independent coils, each independent coil being received in an associated casing and being wound around a cylindrical inner wall of said casing, the cylindrical inner walls of the casings being superposed to make up the tube in which the moving mass slides, each casing also having means for taking up axial forces, and a junction box enabling the corresponding coil to be connected to associated electrical power supply cables, and wherein each coil is received in watertight manner in its associated casing with a reception housing being defined by end rings and by a cylindrical outer wall.

2. An electromagnetic hammer according to claim 1, wherein each coil is held inside its reception housing by a filler resin.

3. An electromagnetic hammer according to claim 1, wherein each casing is defined by a bottom ring and a top ring, one of which is an end ring defining the reception housing for the coil, and the rings being disposed at a distance from each other, with reinforcing spacers being interposed, said rings and spacers constituting said means for taking up axial forces.

4. An electromagnetic hammer according to claim 1, wherein the junction box of each casing is external and waterproof.

5. An electromagnetic hammer according to claim 4, wherein each junction box is disposed between two rings of the casing, and has a waterproof housing associated with inlet and outlet connections of the coil and from which there projects a terminal box receiving elements for connection to corresponding cables.

6. An electromagnetic hammer according to claim 5, wherein the waterproof housing associated with the junction box is filled with a coating material, in particular liquid silicone.

7. An electromagnetic hammer according to claim 1, wherein the casings are interconnected by releasable connections, in particular by bolt fastenings, so that each casing is individually interchangeable.

8. An electromagnetic hammer according to claim 7, wherein the coils are arranged to enable said hammer to operate in an impaired mode in the event of one of the coils being damaged.

9. An electromagnetic hammer according to claim 1, wherein n coils are electrically connected in series or in parallel, with 2n corresponding cables being connected to a connection bar junction box.

10. An electromagnetic hammer according to claim 1, wherein n coils are electrically connected in series, with the two corresponding cables being connected to an external junction box.

* * * * *